US007066000B2

(12) United States Patent
Hammar

(10) Patent No.: US 7,066,000 B2
(45) Date of Patent: Jun. 27, 2006

(54) FORMING TOOL APPARATUS FOR HOT STRETCH-FORMING PROCESSES

(75) Inventor: Richard Harry Hammar, Utica, MI (US)

(73) Assignee: General Motors Corporation, Detroit, MI (US)

( * ) Notice: Subject to any disclaimer, the term of this patent is extended or adjusted under 35 U.S.C. 154(b) by 127 days.

(21) Appl. No.: 10/797,865

(22) Filed: Mar. 10, 2004

(65) Prior Publication Data

US 2005/0199031 A1 Sep. 15, 2005

(51) Int. Cl.
*B21D 37/16* (2006.01)

(52) U.S. Cl. ..... 72/342.92; 72/342.1; 72/342.8; 72/709

(58) Field of Classification Search ..... 72/342.1, 72/342.7, 342.8, 342.92, 57, 60, 709; 100/317, 100/318, 323; 219/645, 647
See application file for complete search history.

(56) References Cited

U.S. PATENT DOCUMENTS 3,015,292 A * 1/1962 Bridwell ..... 72/342.92
3,461,709 A * 8/1969 McMillen ..... 72/342.92
3,584,487 A * 6/1971 Carlson ..... 72/38
3,703,093 A * 11/1972 Komatsu et al. ..... 72/342.4
3,783,669 A * 1/1974 Furney, Jr. ..... 72/342.8
6,810,709 B1 * 11/2004 Hammar et al. ..... 72/342.7
6,886,383 B1 * 5/2005 Kim et al. ..... 72/57
6,910,358 B1 * 6/2005 Schroth ..... 72/57

* cited by examiner

*Primary Examiner*—Ed Tolan
(74) *Attorney, Agent, or Firm*—Kathryn A. Marra

(57) ABSTRACT

A tooling assembly for hot stretch-forming of a sheet metal workpiece. A forming tool is attached to a plate and includes a shell having a forming surface, and support walls that extend away from the shell, that terminate in a rearward surface of the forming tool, and that define open cells between the support walls. Heating elements are embedded within the forming tool for integral and uniform heating thereof. To limit conductive thermal losses from the forming surface, through the forming tool, and to the plate and surrounding environment, the open cells are provided in the forming tool and insulative support posts are disposed between the forming tool and the plate within deep counterbores in the rearward surface of the forming tool. To limit radiative and convective thermal losses, thermal insulation is disposed within the cells and between the forming tool and plate.

10 Claims, 1 Drawing Sheet

FORMING TOOL APPARATUS FOR HOT STRETCH-FORMING PROCESSES

TECHNICAL FIELD

The present invention generally relates to hot stretch-forming of a sheet metal blank within a heated and pressurized forming tool apparatus, wherein the sheet metal blank is formed against a forming surface of the apparatus that defines a final product shape. More specifically, this invention pertains to integrally-heated tooling for a hot blow-forming process wherein the tooling is structured to minimize heat transfer away from the forming surface, and thereby reduce thermal losses of the tooling and increase the thermal efficiency of the process.

BACKGROUND OF THE INVENTION

Sheet metal articles are conventionally produced by forming low carbon steel or aluminum-alloy sheet stock into desired panel shapes, often by conventional room temperature processes such as stamping. Such articles, however, can also be produced by hot blow-forming processes that use complementary forming tools in a press under the pressure of a working gas to stretch-form a preheated sheet metal blank against forming surfaces on the forming tools. Such processes are typically known as super-plastic-forming (SPF) and quick-plastic-forming (QPF), and are particularly applicable to forming blank sheet metal into products of complex three-dimensional curvature, such as automotive body panels.

In particular, QPF tooling is integrally heated to provide more localized heating closer to the workpiece at the forming surface of the tooling. Accordingly, QPF tooling includes internal heating elements embedded therein to provide the heat necessary to carry out the hot blow-forming process. Much of the heat generated by the internal heating elements is efficiently directed toward the forming surface as intended. Some heat, however, is lost via thermal conduction through the tooling and into the press to which the tooling is attached. Also, some heat is lost via thermal radiation from the tooling and into the surrounding ambient shop environment. Thus, it is an object of this invention to provide tooling for a hot blow-forming process that is structured to minimize thermal losses of the tooling and thereby increase the thermal efficiency of the process.

SUMMARY OF THE INVENTION

The present invention provides an improved apparatus for hot blow-forming of a sheet metal blank, wherein integrally-heated tooling is structured to minimize heat transfer from the tooling to a press or to a surrounding ambient environment, thereby reducing thermal losses of the tooling and increasing the thermal efficiency of the process. More specifically, the present invention provides a cellular structured forming tool having internal insulation to limit thermal radiation and convection losses and further having counterbore passages in a rearward surface for accepting thermally insulative support posts, thereby limiting thermal conduction losses.

In accordance with a preferred embodiment of the present invention, the apparatus includes a forming tool that is cast from a suitable alloy such as P20 steel. The forming tool is provided with a forwardly disposed shell, which is preferably about four to six inches in thickness, and a plurality of support walls that are preferably about two to three inches in thickness. The support walls include four perimeter walls, and a pattern of intersecting interior walls that extend longitudinally rearward from the shell and between the perimeter walls to provide support for the load of the forming process on the tooling. A forward surface of the forming tool is finish machined to define the final part surface geometry desired. Also, holes are drilled laterally through the shell and through some of the web walls to provide passages into which electrical resistance heating elements are inserted to integrally heat the forming tool.

The intersecting web walls define open cavities or cells therebetween. Insulation is packed into the open cells to provide resistance to thermal radiation and convection within the discontinuous body of the forming tool. In a rearward surface of the forming tool at the intersections of the intersecting interior walls, there are provided blind passages that are formed or machined therein. A plurality of low thermal conductivity load-bearing support posts are correspondingly inserted and attached within the counterbores and extend beyond a rearward surface of the forming tool along with the insulation. It is contemplated that insulation panels could be attached to the outer periphery of the forming tool.

The entire forming tool is then fastened to a plate, such as an intermediate mounting plate or a platen of a press bed or ram such that rearward surfaces of the support posts mount against the plate and insulation is interposed between the rearward surface of the forming tool and the plate to reduce radiation and convection of heat therebetween. One or more strips of stainless steel are fastened to the sides of the forming tool proximate the rearward surface thereof, to protect and encase the insulation.

Compared to the prior art, the present invention provides an integrally-heated forming tool that is more thermally efficient, such that the energy needed to maintain the tool at its working temperature is lower than ever before possible with SPF and QPF systems. First, the forming tool is provided with a cellular body portion to minimize heat transfer away from the forming surface of the forming tool, such as in a rearward direction toward the press. Second, insulation is packed within cavities of the cellular body portion to reduce thermal convection and radiation therein and away from the shell. Third, the rearward surface of the forming tool is provided with blind passages therein to accommodate use of relatively longer support posts, which tend to enhance resistance to thermal conduction between the forming tool and press. Accordingly, better thermal insulating properties of the forming tool increases the energy efficiency of the hot blow-forming process and thereby decreases associated energy costs, which permits production of lower cost parts.

Other objects and advantages of the invention will become apparent from a detailed description of preferred embodiments of the invention which follow.

DESCRIPTION OF THE PREFERRED EMBODIMENT

The continued use of hot stretch-forming processes, as applied to suitably formable aluminum sheet metal alloys for automotive vehicle body panels and the like, has led to improvements in the functionalities and features of forming tools for such processes. The improvements started with relatively slow SPF practices with fine grain, magnesium-containing, aluminum alloys and such improvements have led to faster forming practices like QPF. Accordingly, double-action forming tools, and integrally-heated and externally-insulated forming tools have also been developed for stretch-forming of aluminum sheet metal alloys. Such integral heating technology has necessitated the development of sophisticated exterior insulation packages for forming tools to reduce heat loss and energy usage. Nonetheless, there remains room for improving the thermal efficiency of QPF tools. Thus, the present invention provides a forming tool structure having improved insulative properties that are believed to reduce heat losses by about 50% or more, as exemplified by the embodiments described below.

Figure 1:
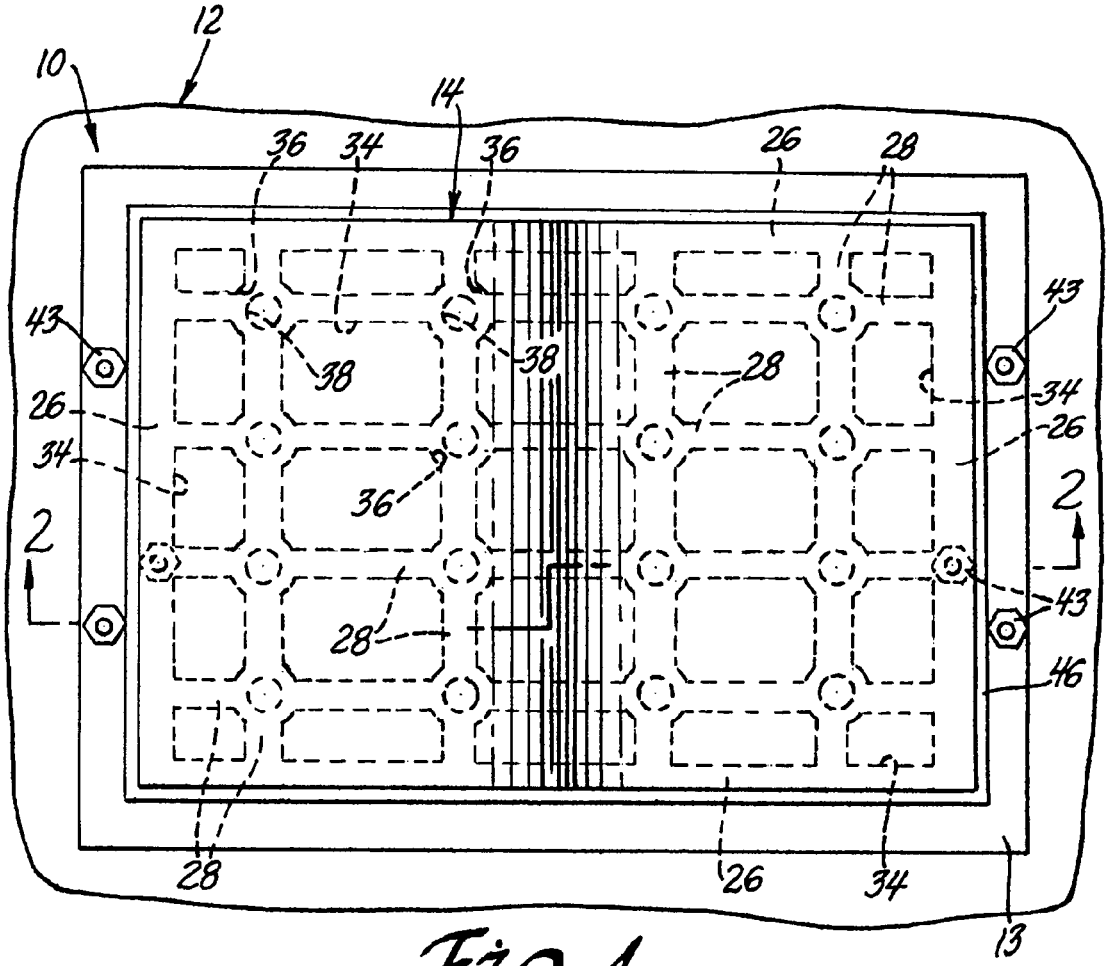
FIG. 1 is a plan view of a forming tool apparatus for a hot blow-forming process in accordance with an embodiment of the present invention.

FIG. 1 illustrates a hot stretch-forming tooling apparatus or assembly 10 that is adapted for attachment to an unheated mounting plate or platen 12 of an unheated press (not shown) in accordance with an embodiment of the present invention. The apparatus includes an integrally-heated forming tool 14 in accordance with another embodiment of the present invention. As shown, a mounting plate 13 may be interposed between the platen 12 and forming tool 14. Accordingly, the forming tool assembly 10 can be pre-mounted to the mounting plate 13 so that the mounting plate 13 and forming tool assembly 10 can be handled as one unit and conveniently mounted to the press platen 12. Alternatively, it is contemplated that the forming tool assembly 10 could be mounted to the press platen 12 without using the intermediate mounting plate 13. Therefore, as defined herein, the mounting plate 13 and platen 12 are synonymous in that both refer to plates to which the forming tool assembly 10 may be attached.

In any case, the forming tool 14 may be composed of any suitable tool grade metal that exhibits durability at SPF or QPF temperatures, for example 450–500° C. Preferably, however, the forming tool 14 is cast from a suitable tooling alloy, such as P20 steel or the like. Alternatively, the forming tool 14 may be machined from a billet of P20 steel or the like. As will be described in more detail below, the forming tool 14 is structured in a cellular arrangement that is similar in concept to a honeycomb structure.

Figure 2:
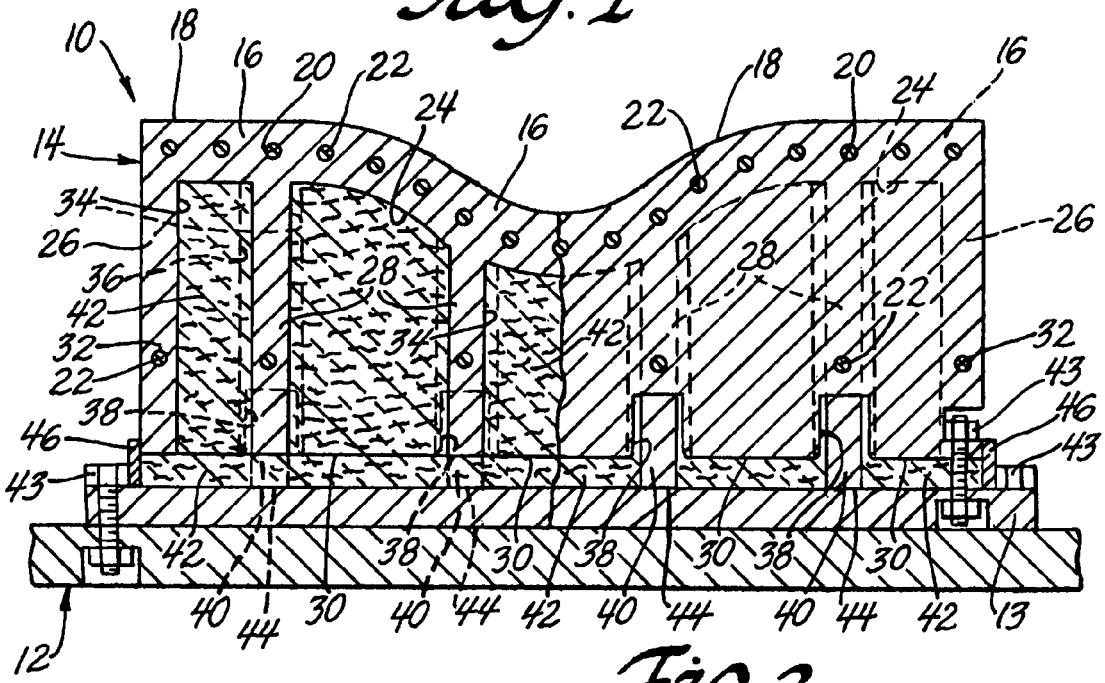
FIG. 2 is an offset cross-sectional view, in elevation, of the forming tool apparatus of FIG. 1, taken along offset line 2—2 thereof.

Referring to FIG. 2, the forming tool 14 includes a layer of predetermined thickness, or shell 16, having a forwardly disposed forming surface 18 of the forming tool 14 that is finish machined to define the final part surface geometry desired. The shell 16 is preferably four to six inches in thickness to provide suitable support to the forming surface 18. The shell 16 also includes holes 20 that are laterally drilled, cast, or otherwise suitably produced through the shell 16 to provide passages into which electrical resistance heating elements 22 are embedded to provide the integral heating source and heat for the hot stretch-forming process. The holes 20 are preferably about ¾ inches in diameter, are spaced about three inches apart from one another, and are all approximately centered between the forward forming 18 surface of the shell 16 and a rearward surface 24, which is disposed substantially opposite of the forming surface 18.

Referring to FIG. 1, the forming tool 14 also includes structures, such as support walls, that are defined by four exterior walls 26 and a pattern of intersecting interior walls 28, all of which are preferably about two to three inches in thickness. As better shown in FIG. 2, the support walls 26, 28 are integral with, and extend longitudinally in a rearward direction away from, the rearward surface 24 of the shell 16, and terminate to define a rearward surface 30 of the forming tool 14 itself. The support walls 26, 28 provide longitudinal support for the process loads on the forming tool 14 and include holes 32 that are drilled, cast, or otherwise suitably produced, laterally therethrough for receiving the heating elements 22 therein. Referring again to FIG. 1, the support walls 26, 28 all intersect to define open cavities or cells 34 therebetween to thereby define a cellular or honeycomb geometrical structure of the forming tool 14. Moreover, the interior walls 28 intersect to define interior, four-way intersections 36. Preferably, the intersections 36 are cylindrically-shaped and are about 3.5 inches in diameter. Blind passages or counterbores 38 of about two to three inches in diameter are drilled, bored, cast, or otherwise produced in the rearward surface 30 (FIG. 2) of the forming tool 14, preferably at the intersections 36 of the interior walls 28.

Referring to FIG. 2, a plurality of low thermal conductivity load-bearing support posts 40 are correspondingly inserted and attached within the counterbores 38 and extend beyond a rearward surface 30 of the forming tool 14. The support posts 40 are preferably spool-shaped and have a maximum outer diameter that is less than the inner diameter of the blind passages 38 in the forming tool 14. The support posts 40 are preferably composed of a relatively thermally insulative material, such as a heat-treated Inconel® 718, a ceramic composite, or the like. The sizes of forming tools are dimensionally constrained in a longitudinal direction by a limited "daylight" dimension of the press. Daylight refers to the maximum clear distance available between the opposing bolster plates of a press when the press ram is in a fully usable open position. Therefore, prior art forming tools can accommodate only relatively short thermally insulative support posts, which are about three to four inches in length, disposed between a bottom of a forming tool and a bolster plate. The present invention, however, provides the counterbored rearward surface 30 of the forming tool 14 to enable use of relatively longer support posts 40 having lengths of six inches or greater for an increase in length of 100% or more. As a result, thermal conduction losses through the forming tool are reduced, perhaps by 50% or more. This is because the support posts 40 have lower thermal conductivity than the forming tool material and because use of longer support posts translates into greater dissipation of thermal conductivity so that less heat is conducted and lost through the forming tool 14 and into the press platen 12.

Insulation 42 is packed into the cells 34 to provide resistance to thermal radiation and convection within the cellular body of the forming tool 14. The insulation 42 may also extend rearwardly of the rearward surface 30 of the forming tool 14 as shown. It is contemplated that exterior insulation panels could be attached to the lateral exterior of the forming tool 14. The insulation 42 may be any suitable type of thermal insulation, but is preferably a fibrous blanket insulation product that is readily commercially available, such as Cer-Wool RT available from Premier Refractories and Chemicals, Inc. of King of Prussia, Pa.

The electrical resistance heating elements 22 are embedded within the forming tool 14, such as being inserted within the drilled holes 20, 32 from one end or side of the forming tool 14 to another. The heating elements 22 are suitably connected to an electrical power delivery and control system (not shown) to thereby provide an integral heating source and heat that is capable of maintaining suitable forming temperatures for the hot blow-forming process. Although the majority of the heating elements 22 are embedded in the shell 16 proximate the forming surface 18 of the forming tool 14, several heating elements 22 are located a predetermined distance away from the forming surface 18 in the support walls 26, 28. Locating heating elements 22 in the shell 16 and in the cellular body of the forming tool 14 distally from the forming surface 18 ensures that both the forming surface 18, as well as the cellular body portion of the forming tool 14, are maintained at a predetermined uniform temperature. Such uniformity of the temperature throughout the forming tool 14 tends to provide more uniform process temperatures and to prevent warping of the forming tool 14 during heat-up and at elevated temperatures.

The entire forming tool 14, including support posts 40 and insulation 42, is preferably fastened to the mounting plate 13 which, in turn, is fastened to the platen 12 of a press bed or ram (not shown) such that the rearward surfaces 30 of the exterior walls 26 are about an inch away from the mounting plate 13. The forming tool 14 may be fastened to the mounting plate 13, and the mounting plate 13 to the platen 12, by any suitable means such as nut and bolt fasteners 43, or the like. Moreover, the forming tool 14 is mounted such that rearward surfaces 44 of the support posts 40 mount against the mounting plate 13, and so that the insulation 42 is interposed between the rearward surface 30 of the forming tool 14 and the mounting plate 13 to reduce radiation and convection of heat therebetween. One or more strips 46 of stainless steel are attached to the lateral exterior of the forming tool 14, proximate the rearward surface 30 thereof to cover the gap and protect and confine the insulation 42. The strips 46 are preferably about 1/16 of an inch thick or less and are fastened to the forming tool 14 such as by sheet metal screws or the like (not shown).

It should be understood that the invention is not limited to the embodiments that have been illustrated and described herein, but that various changes may be made without departing from the spirit and scope of the invention. Accordingly, it is intended that the invention not be limited to the disclosed embodiments, but that it have the full scope permitted by the language of the following claims.

What is claimed is:

1. A tooling assembly for hot stretch-forming of a heat-softened sheet metal workpiece, said tooling assembly being adapted for attachment to a plate, said tooling assembly comprising:

a forming tool formed of an integral body of metal and including:

a layer of predetermined thickness, said layer having a forwardly disposed forming surface thereon against which said workpiece is formed; and a plurality of structures extending rearwardly from said layer and terminating in a rearward surface of said forming tool, said plurality of structures being adapted to support said layer, said plurality of structures defining at least one open cell therebetween to reduce thermal losses emanating away from said forming surface due to at least one of thermal conduction and thermal radiation;

a plurality of electrical resistance heating elements embedded within said layer for integrally heating said forming surface to enable hot stretch-forming of said workpiece;

thermal insulation disposed within said at least one open cell of said forming tool to reduce thermal losses emanating away from said forming surface due to at least one of thermal radiation and thermal convection; and a plurality of insulative support posts disposed between said forming tool and said plate to establish a gap therebetween, said insulative support posts having greater resistance to thermal conductivity than said forming tool.

2. The tooling assembly as recited in claim 1, further comprising:

said plurality of structures including a plurality of exterior walls and a plurality of interior walls defining a plurality of open cells therebetween, said plurality of interior walls intersecting to define a plurality of intersections; and said plurality of heating elements also being embedded within said plurality of structures to provide uniform heating of said forming tool to avoid warpage thereof.

3. The tooling assembly as recited in claim 1, further comprising:

said rearward surface having a plurality of blind passages provided therein, said plurality of load-bearing support posts being disposed within said plurality of blind passages and having rearward surfaces for mounting against said plate.

4. The tooling assembly as recited in claim 3, wherein said plurality of blind passages are formed at said plurality of intersections.

5. The tooling assembly as recited in claim 4, wherein said rearward surface is spaced a predetermined distance from said plate to define a gap therebetween, further wherein said thermal insulation is disposed between said rearward surface of said forming tool and said plate.

6. The tooling assembly as recited in claim 5, further comprising at least one cover strip peripherally attached to said plurality of exterior walls of said forming tool so as to contain said insulation and cover said gap.

7. A forming tool apparatus for hot stretch-forming of a heat-softened sheet metal workpiece, said forming tool apparatus comprising:

a forming tool formed of an integral body of metal including:

a layer of predetermined thickness, said layer having a forwardly disposed forming surface thereon against which said workpiece is formed; and a plurality of support structures extending rearwardly from said layer and terminating in a rearward surface of said forming tool, said plurality of support structures being adapted for supporting said layer and defining at least one open cell between said plurality of support structures to reduce thermal losses emanating away from said forming surface due to at least one of thermal conduction and thermal radiation;

a plurality of electrical resistance heating elements embedded within said layer for integrally heating said forming surface to enable hot stretch-forming of said workpiece; and thermal insulation disposed within said at least one open cell of said forming tool to reduce thermal losses emanating away from said forming surface due to at least one of thermal radiation and thermal convection.

8. The forming tool apparatus as recited in claim 7, wherein said plurality of structures includes a plurality of exterior walls, and a plurality of interior walls defining a plurality of intersections, said plurality of structures defining a plurality of open cells.

9. The forming tool apparatus as recited in claim 8, wherein said heating elements are also embedded within said plurality of structures of said forming tool to provide uniform heating of said forming tool to avoid warpage thereof, and further wherein said thermal insulation is disposed within said plurality of open cells of said forming tool to reduce thermal losses emanating away from said forming surface due to at least one of thermal radiation and thermal convection.

10. An apparatus for hot stretch-forming of a heat-softened sheet metal workpiece, said apparatus being adapted for attachment to a plate, said apparatus comprising:

a forming tool formed of an integral body of metal and including a forwardly disposed forming surface thereon and a rearward surface disposed substantially opposite of said forming surface, said rearward surface having a plurality of blind passages therein;

a plurality of electrical resistance heating elements embedded within said forming tool for integrally heating said forming surface for hot stretch-forming said workpiece; and a plurality of load-bearing support posts disposed within said plurality of blind passages of said forming tool, said plurality of load-bearing support posts having a plurality of rearwardly disposed surfaces located against said plate, wherein said load-bearing support posts are composed of a thermally resistant material having greater resistance to thermal conductivity than said forming tool.

* * * * *